US010338626B2

(12) United States Patent
Lewis

(10) Patent No.: US 10,338,626 B2
(45) Date of Patent: Jul. 2, 2019

(54) ROLLING HINGE ASSEMBLY

(71) Applicant: Linemaster Switch Corporation, Woodstock, CT (US)

(72) Inventor: Sean Lewis, Holland, MA (US)

(73) Assignee: Linemaster Switch Corporation, Woodstock, CT (US)

( * ) Notice: Subject to any disclaimer, the term of this patent is extended or adjusted under 35 U.S.C. 154(b) by 0 days.

(21) Appl. No.: 15/633,190

(22) Filed: Jun. 26, 2017

(65) Prior Publication Data

US 2018/0373284 A1 Dec. 27, 2018

(51) Int. Cl.

| | |
|---|---|
| ***E05F 1/14*** | (2006.01) |
| ***E05D 11/10*** | (2006.01) |
| ***G05G 1/30*** | (2008.04) |
| ***G05G 1/445*** | (2008.04) |
| ***G05G 1/46*** | (2008.04) |
| ***E05F 1/12*** | (2006.01) |
| ***H01H 3/14*** | (2006.01) |
| ***G05G 5/05*** | (2006.01) |

(52) U.S. Cl.

CPC ..... *G05G 1/30* (2013.01); *E05D 11/10* (2013.01); *E05F 1/12* (2013.01); *G05G 1/445* (2013.01); *G05G 1/46* (2013.01); *G05G 5/05* (2013.01); *H01H 3/14* (2013.01)

(58) Field of Classification Search

CPC ..... Y10T 16/53826; Y10T 16/5383; Y10T 16/5398; Y10T 16/53984; Y10T 16/53985; Y10T 16/53987; Y10T 16/526; Y10T 16/54028; E05D 11/10; E05D 11/1007; E05D 11/1064; E05F 1/12; E05F 1/1246; E05F 1/1253; E05Y 2201/638; G05G 1/30; G05G 1/44; G05G 1/445; G05G 1/46

See application file for complete search history.

(56) References Cited

U.S. PATENT DOCUMENTS 938,952 A * 11/1909 Berg ..... E05F 5/027 16/334
3,837,735 A * 9/1974 Guillet ..... G02C 5/2227 16/228

(Continued)

FOREIGN PATENT DOCUMENTS

JP 03228986 A * 10/1991

*Primary Examiner* — Chuck Y Mah

(74) *Attorney, Agent, or Firm* — Alix, Yale & Ristas, LLP

(57) ABSTRACT

A hinge assembly includes a pivoting body attached to a base with a front surface. The pivoting body has a front end and rear end and at least one friction reducing member biased rearwardly against the front surface of the body. The friction reducing member is retractable relative to the pivoting body substantially parallel to the direction of the bias. The front surface has an inclined portion and an apex. When the pivoting body is in a rest position the at least one friction reducing member is maintained at the apex. The pivoting body is pivotable in a first direction to an activation that causes the friction reducing member to roll along the inclined portion with the friction reducing member retracting in the forward direction against the bias. When force is removed from the pivoting body in the activation position, the bias against the contoured front surface returns the pivoting body to the rest position via indirect forces.

24 Claims, 9 Drawing Sheets

(56) References Cited

U.S. PATENT DOCUMENTS

| | | | | | |
|---|---|---|---|---|---|
| 4,976,166 | A * | 12/1990 | Davis | F02D 41/28 | 338/153 |
| 5,237,891 | A * | 8/1993 | Lundberg | B60K 26/02 | 200/61.89 |
| 5,515,575 | A * | 5/1996 | Pinazza | G02C 5/2227 | 16/228 |
| 5,815,899 | A * | 10/1998 | Chao | G02C 5/008 | 29/20 |
| 6,393,664 | B1 * | 5/2002 | Habegger | E05D 11/1014 | 16/228 |
| 6,584,642 | B2 * | 7/2003 | Hodson | E05F 5/08 | 16/85 |
| 6,612,628 | B1 * | 9/2003 | Herbst | E05C 17/34 | 16/324 |
| 6,651,295 | B2 * | 11/2003 | Hodson | E05F 5/08 | 16/82 |
| 6,721,991 | B2 * | 4/2004 | Dioguardi | G02C 5/2227 | 16/228 |
| 6,766,563 | B2 * | 7/2004 | Lee | A23B 7/0425 | 16/281 |
| 6,916,093 | B2 * | 7/2005 | Quehin | G02C 5/10 | 16/228 |
| 7,028,373 | B2 * | 4/2006 | Harmon | E05D 11/1064 | 16/284 |
| 7,069,622 | B2 * | 7/2006 | Ohara | B41J 29/13 | 16/286 |
| 7,387,048 | B2 * | 6/2008 | Furuta | G05G 1/445 | 74/560 |
| 2016/0348919 | A1 * | 12/2016 | Ivanovic | E05F 1/1261 | |

* cited by examiner

ROLLING HINGE ASSEMBLY

BACKGROUND

The disclosed embodiments relate to hinge, and in particular a hinge with a friction reducing member biased against a surface, for example a bearing against a rolling surface.

Hinge assemblies are well known and in use in many technical fields, such as for example pedals for activating a switch. In particular, hinge assemblies that bias a pedal toward a rest state, deactivation position, are common in medical fields and industrial settings. Such devices are typically referred to as foot switches. For example, hinges are used in many activatable foot switches including, for example, electromechanical, ratiometric, potentiometer, encoder, hydraulic, pneumatic, linear hall effect, magnetic, digital, linear and wireless infra-red and radiofrequency (RF), infrared (IR), photo, optical, inductive, capacitive, resistive, force, inertial and sound switches.

A common characteristic in many known hinged foot switches is that they have two positions—a rest/deactivation position and an activated position. Usually, a pivoting body (i.e., treadle) is attached to a base and biased into the rest position away from the position that activates the switch. The bias on the foot pedal can come in a variety of mechanisms, with the most widespread being a compressed spring or springs positioned between the base and pedal underneath the pedal to bias the pedal away from the base (i.e., biasing upward against the pedal in most devices). The switch is activated by forcing the pedal against the bias toward an activation position, usually by a user stepping on the switch. In many medical and industrial settings, the devices are exposed to debris, contaminants and/or other materials that get trapped underneath the pedal.

Such devices with a spring biasing a pedal in the direction opposite from or substantially perpendicular to the direction of movement of the treadle carry several drawbacks. Since the pedal is only movable up and down between the rest position and activation position, areas underneath the pedal fill with debris and/or corrode because they are concealed by the pedal in both rest and activation positions and thus difficult or impossible to clean.

SUMMARY

It would be useful to provide an improvement to conventional hinge assemblies that provides a bias in a direction other than perpendicular to the direction of movement of the pivoting body/foot pedal and allows exposure of areas underneath the pedal.

In one disclosed embodiment, a hinge assembly includes a base member with a front surface and a pivoting body with a front and a rear end. The pivoting body is attached and pivotable relative to the base member about an axis that is rear of the front surface. The pivoting body has a friction reducing member that is biased against the front surface of the base. The friction reducing member is retractable relative to the pivoting body in a rear-to-forward direction. The front surface includes a first inclined portion and the pivoting body is maintained in a rest position with the friction reducing member at an apex in the front surface. The pivoting body is pivotable in a first direction causing the friction reducing member to move along the first inclined portion while retracting forward relative to the pivoting body.

In another embodiment, a hinge assembly has a base member and a pivoting body attached to the base member. A friction reducing member is attached to the pivoting body in abutment with a surface on the base member. The pivoting body is rotatable relative to the base member. The pivoting body is pivotable from rest position with the friction reducing member in a first position against the base member surface to an activation position with the friction reducing member in a second position against the base member surface. The friction reducing member moves against the base member from the first position to the second position while retracting relative to the pivoting body when the pivoting body is pivoted from the rest position to the activation position.

In yet another embodiment, a hinge assembly includes a base member, a pivoting body and a friction reducing member comprising a bearing. The base member defines a rolling surface with a lower ramp portion and an upper ramp portion that meet at a apex. The pivoting body extends from a front end to a rear end and is attached to the base member via engagement with a laterally extending pin defining an axis. The pin is positioned rear of the rolling surface. The friction reducing member is engaged with the pivoting body, reciprocable relative to the pivoting body in a rear-to-forward direction and biased relative to the pivoting body toward the rear direction. The bearing is maintained against the rolling surface in an intermediate position at the apex by the rearward bias. The pivoting body is pivotable about the axis in a first direction from the intermediate position to a lowered position with the bearing rolling along the lower ramp. The pivoting body is pivotable about the axis in a second direction opposite of the first direction from the intermediate position to a raised position by disengaging the bearings from the apex.

Notably, the embodiments of the hinge disclosed herein are not limited to the context within which they are primarily described in the Detailed Description below (i.e., operable in a foot activation pedal).

BRIEF DESCRIPTION OF THE DRAWINGS

Aspects of the preferred embodiment will be described with reference to the drawings, wherein like numerals reflect like elements throughout.

DETAILED DESCRIPTION

Among the benefits and improvements disclosed herein, other objects and advantages of the disclosed embodiments will become apparent from the following wherein like numerals represent like parts throughout the several figures. Detailed embodiments of a rolling hinge assembly are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
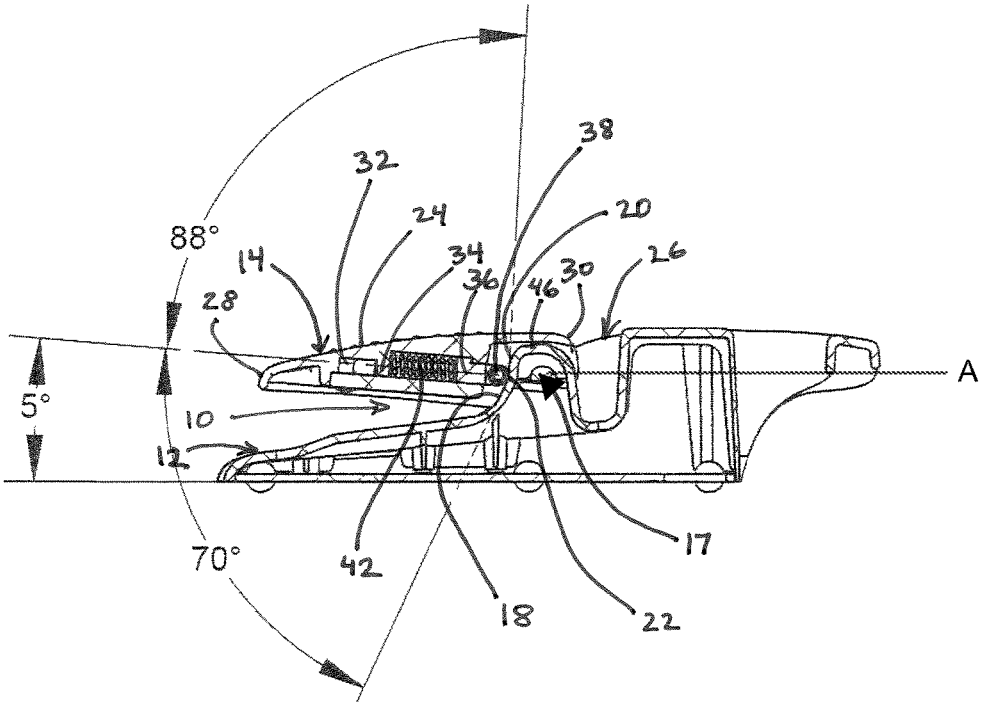
FIG. 1 depicts an embodiment of the disclosed hinge assembly in a rest position.

First, with reference to FIGS. 1-9, a hinge assembly 10 includes a base member 12 and a pivoting body 14 pivotable relative to the base member 12 about a laterally extending axis A. As shown in FIG. 1, axis A is defined by a pivot pin 17 which attaches the pivoting body 14 rotatably to the base member 12. In the exemplary embodiment depicted, the hinge assembly 10 is described with reference to an activation pedal, wherein the pivoting body 14 is a treadle for activation by a foot or similar, however this context is not limiting to the utility and environments and systems within which the disclosed hinge assembly 10 can be incorporated.

Figure 8:
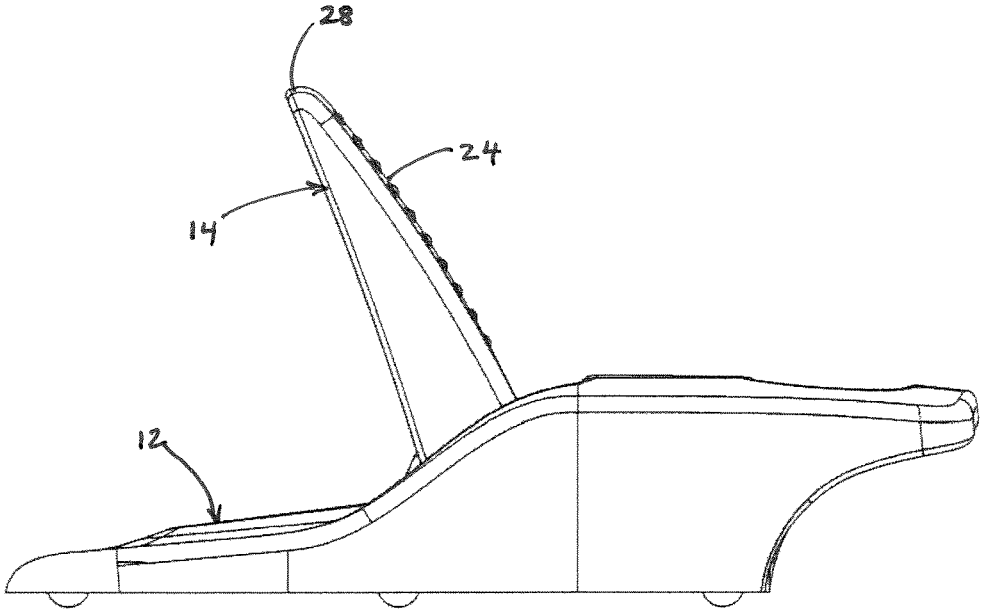
FIG. 8 is a perspective view of the foot pedal of FIG. 4 in the raised position.

The base member 12 defines a front surface 16 that extends laterally, as shown most clearly in the perspective view shown in FIG. 8. The front surface 16 includes a lower ramp portion 18 and an upper ramp portion 20 that meet at an apex 22. The lower ramp portion 18 transitions downward from proximate the apex 22 concavely in the forward direction, while the upper ramp portion 20 transitions upward from proximate the apex 22 in a convex configuration. The upper ramped portion 20 transitions upward and rearward circumferentially to define a top surface 46 and a rear opening 26.

Figure 9:
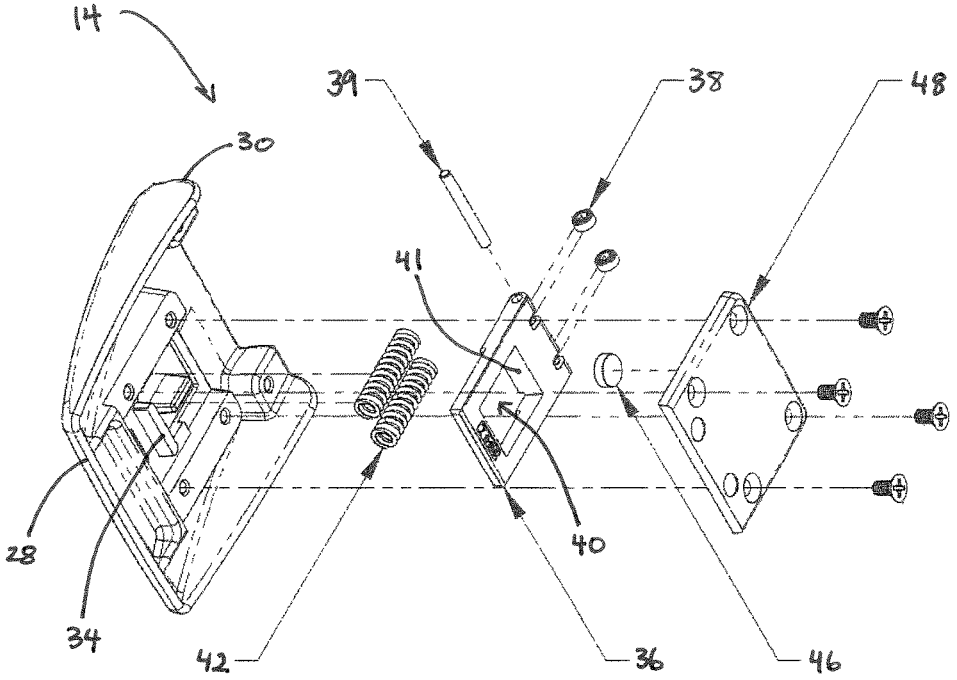
FIG. 9 is an exploded view of a pivoting body of the disclosed hinge assembly of FIG. 1.

As shown, the pivoting body or treadle 14 defines a top surface extending from a front end 28 to a rear end 30. The pivoting body also defines an inner track 32. The inner track 32 is opened at its rear and closed at its front end with an intermediate shoulder 34 therebetween. The track 32 receives a plate 36 in a front-to-rear sliding relationship. The plate 36 maintains at least one friction reducing member 38 at its rear and defines a central opening 40. The plate 36 is positioned within the track with the shoulder 34 within the plate opening 40 and the friction reducing member at least partially exposed from the track. At least one bias member 42 is positioned between the shoulder 34 and rear edge 41 of the opening 40, to thereby bias the plate 36 rearwardly relative to the pivoting body 14. The configuration of the plate 36 with opening 40 and rear edge 41 can be seen most clearly in the exploded view of FIG. 9. Also shown in FIG. 9 is a separate cover 48 secured to the underside of the pivoting body 14 to conceal the track and other inner elements, such as the bias members. In the depicted preferred embodiment, the at least one bias member 42 comprises two parallel helical springs compressed between the shoulder 34 and rear edge 41. Additionally, in the depicted embodiment, the at least one friction reducing member 38 comprises a pair of bearings (and more specifically, roller bearings) secured at the rear end of the plate via a pin 39 (see FIG. 9). Of course, the absolute numbers and types of bias member(s) 42 and friction reducing member(s) 38 in the disclosed preferred embodiments are non-limiting. Another embodiment that is not depicted includes a plate with an end surface or similar integrated member that abuts the surface of the base and slides along the surface when the pivoting body is rotated.

Figure 4:
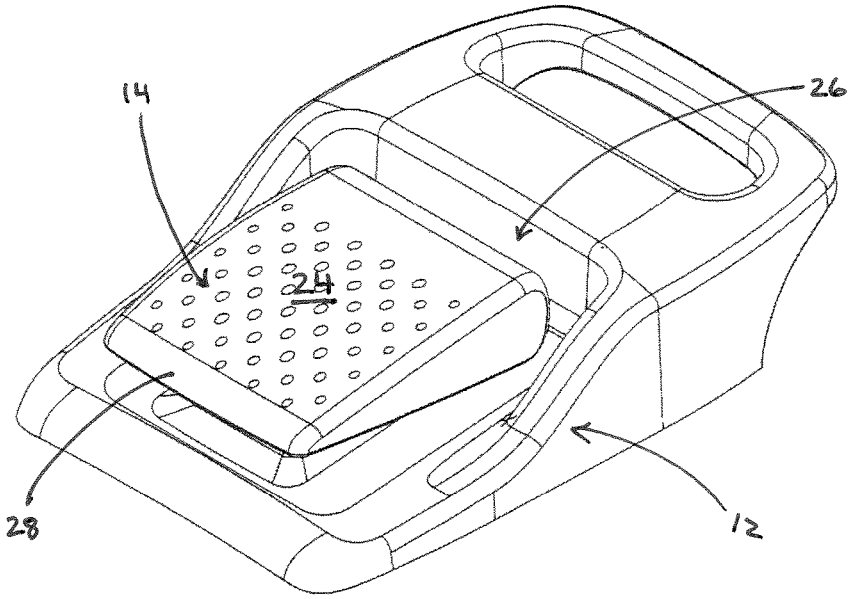
FIG. 4 is a perspective view of a foot pedal within which the hinge assembly is incorporated.
Figure 5:
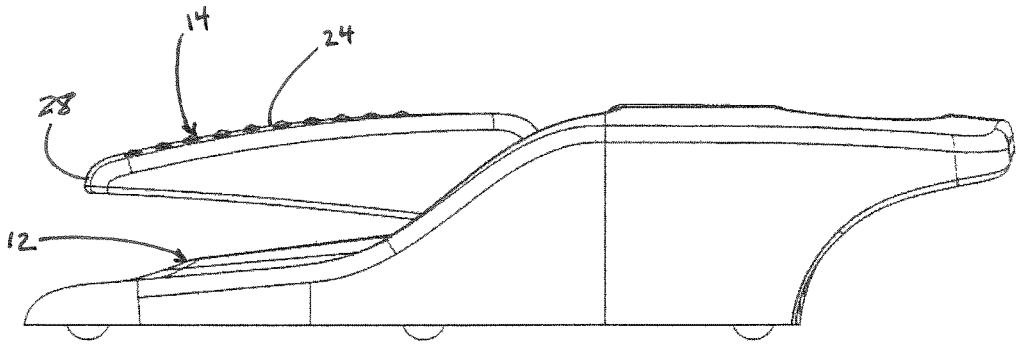
FIG. 5 is a side elevation view of the foot pedal of FIG. 4.
Figure 6:
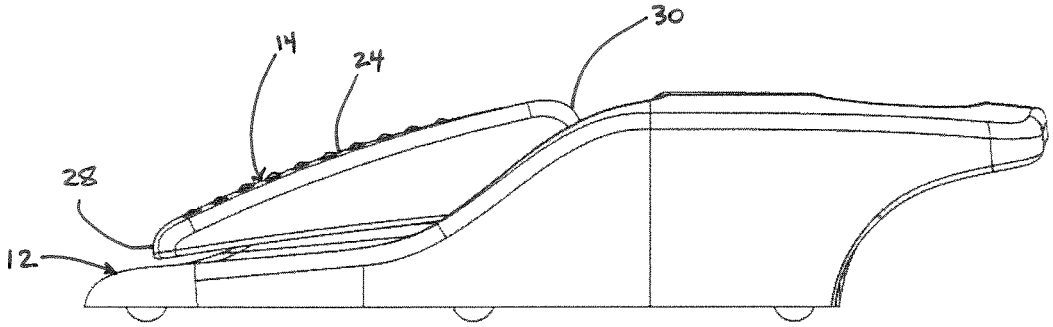
FIG. 6 is a side elevation view of the foot pedal of FIG. 4 in the activated position.
Figure 7:
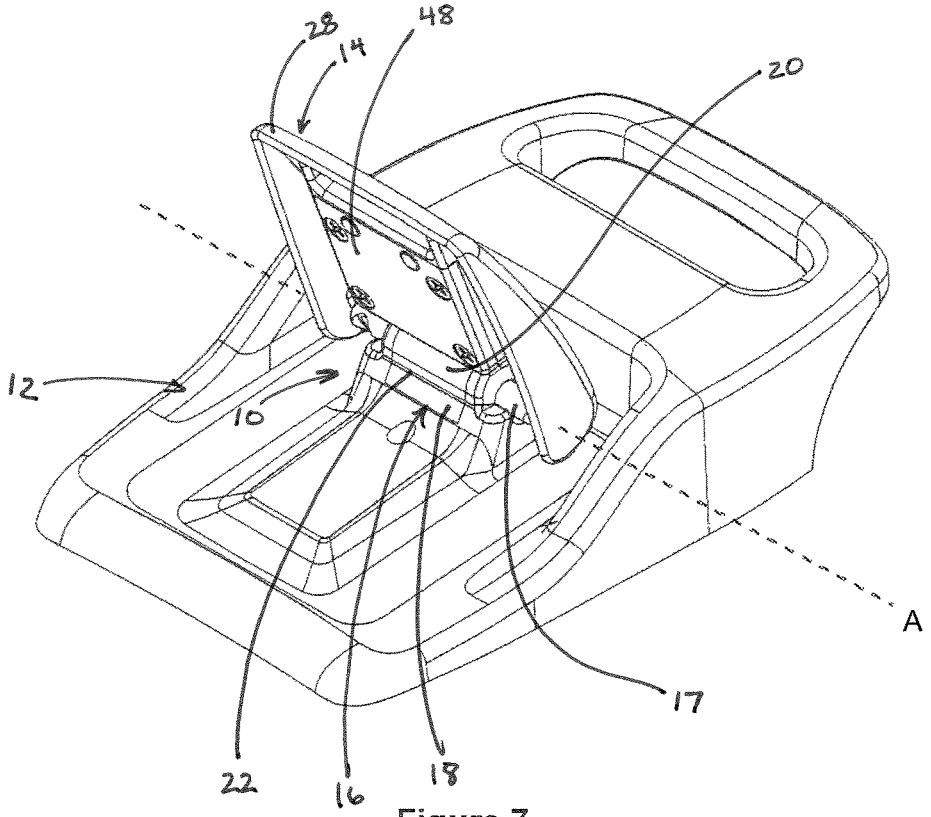
FIG. 7 is a side elevation view of the foot pedal of FIG. 4 in the raised position.

The pivoting body 14 is secured in a pivotable relationship to the base member 12 via a pin 17 that is rear of the front surface 16 of the base with the friction reducing members 38 held tightly against the front surface 16 by the bias members 42. While not shown explicitly in the drawings, the pivoting body 14 and pin 17 are rigidly attached to one another such that they pivot about the axis A in unison. The surface configuration of the front surface 16 is such that the rearward biasing force on the plate 36 and friction reducing members 38 in a direction substantially parallel to the pivoting body 14 naturally indirectly maintains the friction reducing members 38 against the front surface at or near the apex 22. The intermediate "rest" position of the hinge assembly 10 is depicted in FIGS. 1, 4 and 5.

The hinge assembly 10 is movable to a lowered "activated" position via application of a force F downward on the pivoting body 14. In the depicted preferred embodiment, the force F is typically applied via a user stepping on the top surface 24 to depress the treadle. The exact manner of activation can vary, but non-limiting examples of preferred activation techniques include a lever pivoting with the pin 17 to depress a button (mechanical), a different mechanical depression of an activation button, electromechanical, ratiometric, potentiometer, encoder, hydraulic, pneumatic, linear hall effect, magnetic, digital, linear and wireless infra-red and radiofrequency (RF), infrared (IR), photo, optical, inductive, capacitive, resistive, force, inertial and sound. For example, FIG. 9 shows a magnetic element 46 embedded in a plate 48 on the pivoting body 14.

Figure 2:
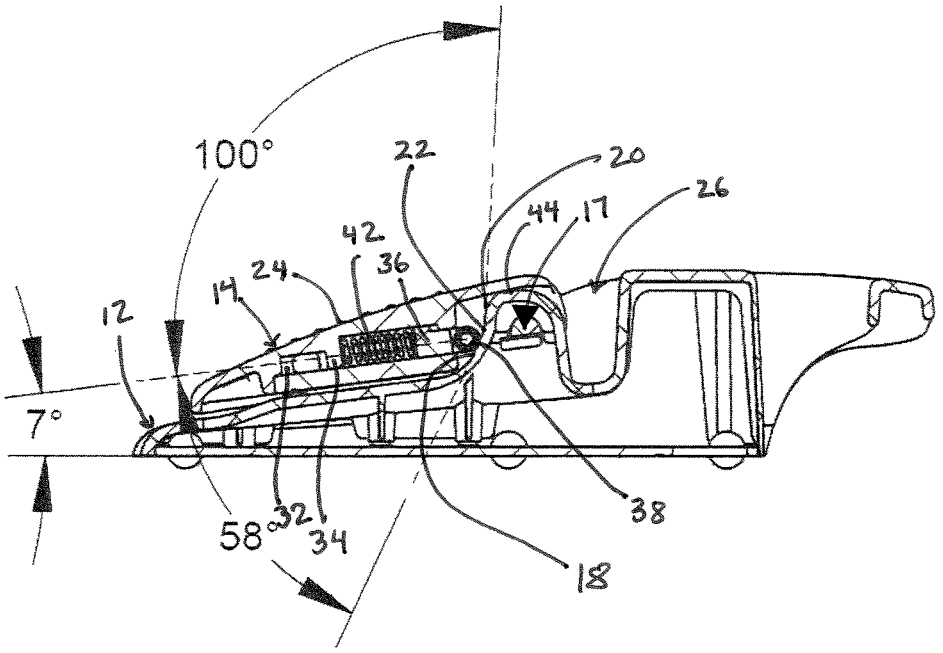
FIG. 2 depicts the hinge assembly of FIG. 1 in an activated position.

As shown in the representative depiction of the activated position in FIG. 2, as the treadle 14 is pivoted downward, the sliding engagement with the plate 36 allows the friction reducing members 38 to roll down the lower ramp portion 18 of the front surface of the base 12 with the plate 36 sliding forward into the track 32 against the biasing force of the springs 42, which compress between the rear edge 41 and shoulder 34. Once the force F is removed (for example, by the user lifting his foot), the rearward bias from the springs 42 naturally causes the friction reducing members 38 to roll back up the lower ramp portion 18 and return to the apex 22 (i.e., indirectly biasing the pedal upward).

As discussed above, in this embodiment, the front surface 16 transitions upwardly from the apex 22 via a convex upper portion 20 into a partial circumferential surface about the axis A of rotation. It is noteworthy that additional embodiments of the hinge assembly 10 exist with lower portions and/or upper portions with generally flat surfaces that incline to provide the rolling surface for the friction reducing members 38. A key consideration in this embodiment is that the lower portion 18 and upper portion 20 extend at least slightly obliquely relative to one another at the vertex 22 to form the natural intermediate rest position for the friction reducing members 38. The oblique relationship at the vertex 22 can be viewed illustratively with reference to the broken lines in FIG. 1, which generally represents hypothetical tangent planes at the vertex.

Figure 3:
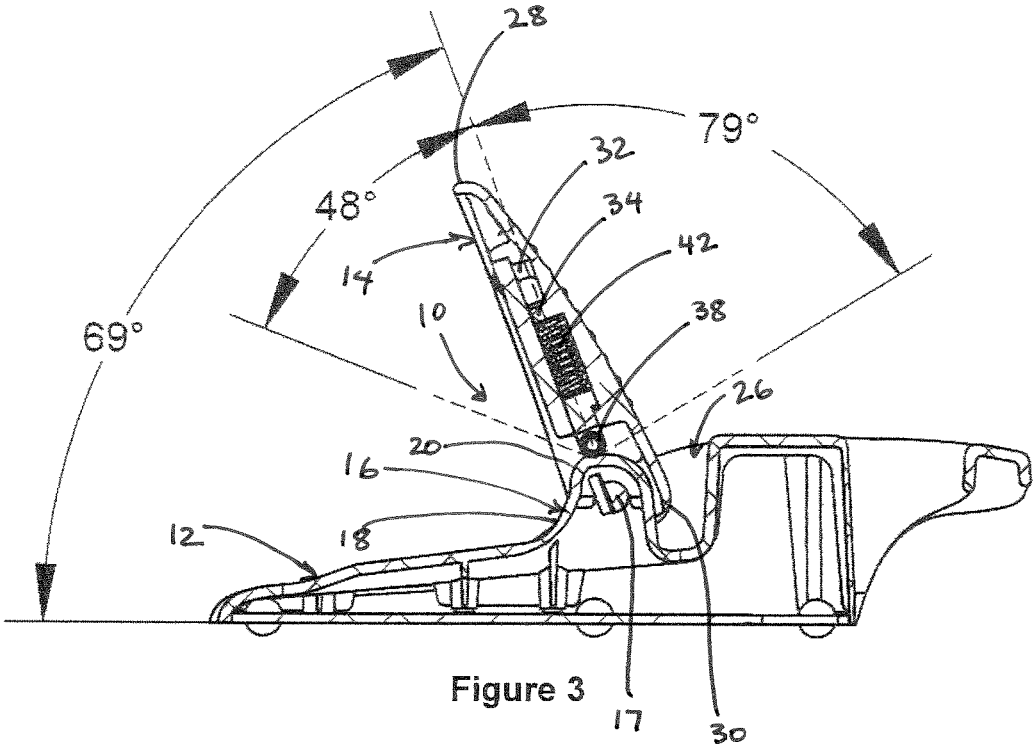
FIG. 3 depicts the hinge assembly of FIG. 1 in a raised position.

In this embodiment, the pivoting body 14 can be pivoted from the intermediate rest position (FIG. 1) via application of a force $F_2$ in an upward direction. In the depicted embodiment within an activation pedal or foot switch, this typically comes from a user pulling the pivoting body 14 at a force $F_2$ strong enough to overcome the rearward force of the bias members 42 that maintains the friction reducing members 38 at the apex 22 to retract the slide plate 36 into the inner track 32. As the pivoting body 14 pivots upward (clockwise in FIGS. 1-3), the friction reducing members 38 roll along the convex upper portion 20. The upper portion 20 transitions circumferentially to a detent 44 near the top. In operation, the detent 44 receives and engages the friction reducing members 38 that are biased into the detent to lock the pivoting body 14 in the raised position shown in FIG. 3. With primary reference to FIGS. 7 and 8, in use within the context of a foot pedal, the raised position is particularly advantageous for allowing cleaning of surfaces of the base 12 underneath the treadle 14 as well as underneath the treadle 14 and removing debris. Also shown in FIGS. 1-3 is the rear opening 26 positioned rear to the pin 17. As FIG. 3 shows clearly, the rear opening 26 accommodates the rear end 30 as the pivoting body 14 is rotated rearward toward the raise position.

Figure 10:
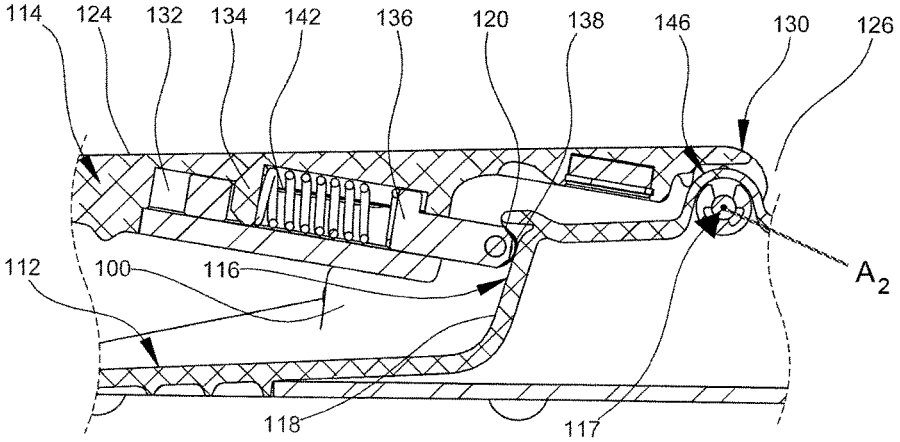
FIG. 10 shows another embodiment of the disclosed hinge assembly in a rest position.
Figure 11:
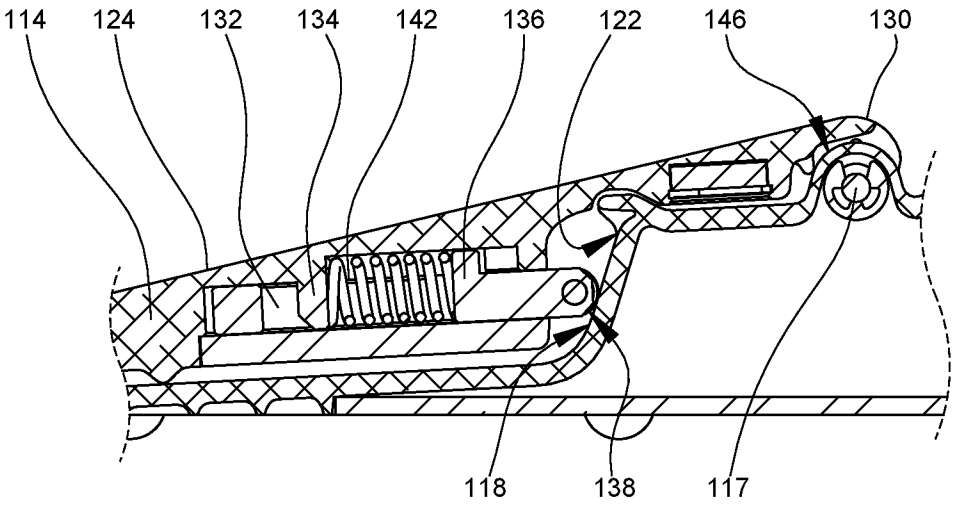
FIG. 11 shows the hinge assembly of FIG. 10 in an activated position.
Figure 12:
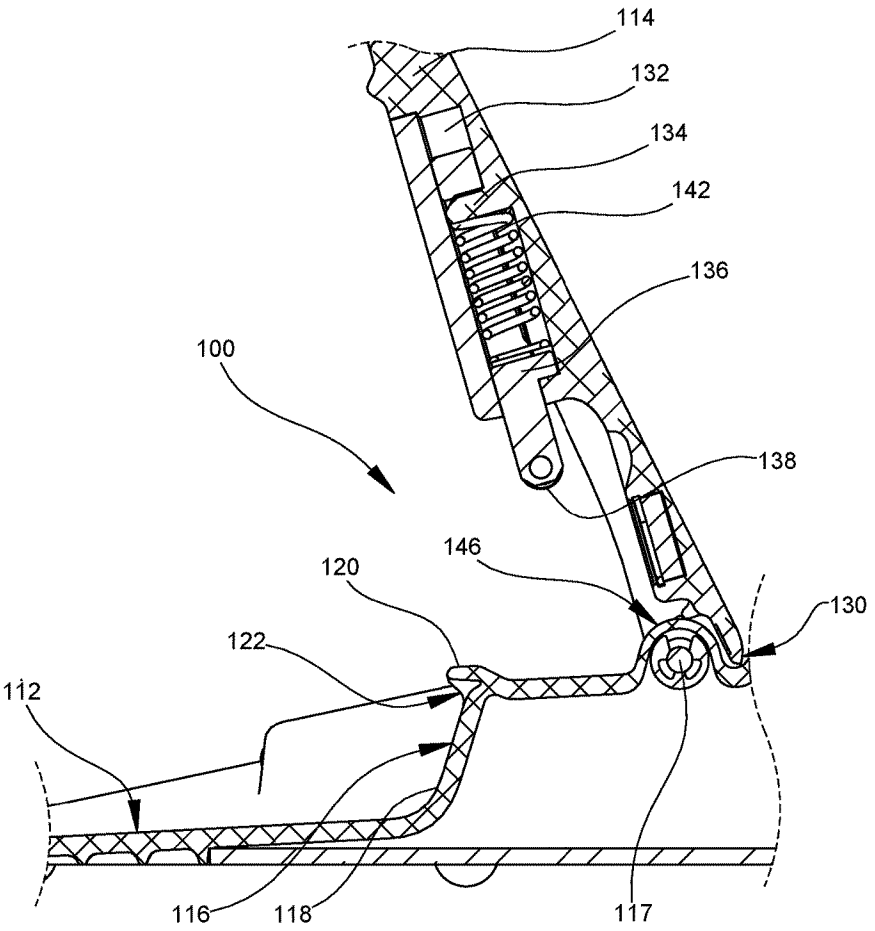
FIG. 12 shows the hinge assembly of FIG. 10 in a raised position.

FIGS. 10-12 depict another embodiment of the disclosed rolling hinge assembly 100, shown in a cropped view within a foot pedal (though this environment is not a requirement). Like the previous embodiment, the hinge assembly 100 includes a pivoting body 114 pivotably secured to a base 112. The body 112 defines a front surface 116 with a lower ramp portion 118. In this embodiment, an upper shoulder 120 extends forward of the surface of the lower ramp portion 118 proximate a top end of the lower ramp portion. In operation, the upper shoulder 120 acts as a stop to maintain the pivoting body 114 in an intermediate position with the friction reducing members 138 at the apex 122, as shown in FIG. 10.

Figure 14:
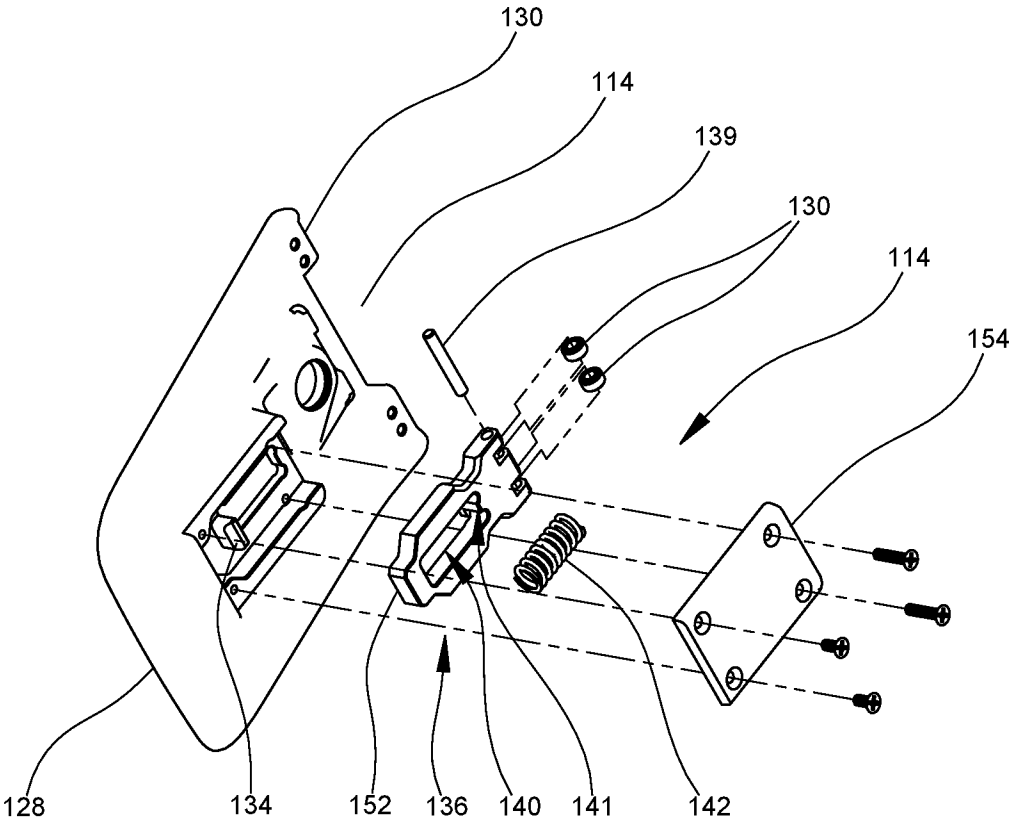
FIG. 14 is an exploded view of a pivoting body of the disclosed hinge assembly of FIG. 10.

Like the previously disclosed embodiment, the pivoting body 114 includes an inner track 132 with an intermediate shoulder 134. A plate 136 is slidably received by the track 132 with the shoulder 134 extending into a central opening in the plate 136. The plate includes at least one friction reducing member 138 attached at its rear in a rotatable engagement. In the depicted preferred embodiment, the at least one friction reducing member comprises two bearings attached via a laterally extending pin 139. At least one bias member 142 is maintained within the track 132 between the shoulder 134 and a rear edge 141 of the plate opening 140 to bias the plate rearward (toward the front surface 116 of the base 112 when the hinge is in the intermediate position of FIG. 10 or lowered activation potion of FIG. 11). With reference to the exploded view of the pivoting body 114 shown in FIG. 14, the plate 136 in this embodiment includes two opposing intermediate side notches 150 and a chamfered front end 152. Additionally, this embodiment of the hinge assembly 100 includes a single bias member 142 positioned within the plate opening 140 between the shoulder 134 and rear edge 141 of the plate. A cover 154 may be included and secured to the underside of the pivoting body 114 to conceal the track and other inner elements, such as the bias member.

Figure 13:
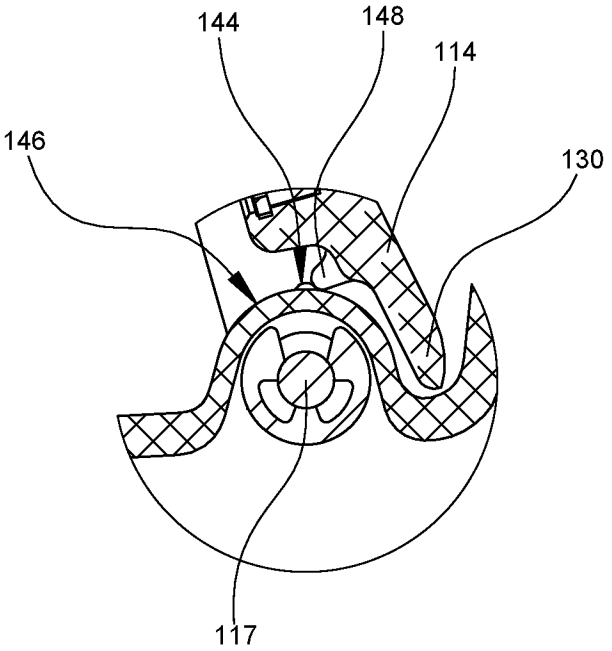
FIG. 13 is an enlarged view of the locking mechanism of the embodiment of FIG. 10 in the raised position.

As depicted in FIGS. 10-12, the pivoting body 114 is attached at its rear end 130 to the base 112 via a pin 117 that defines an axis $A_2$ of rotation of the pivoting body 114. With reference to the enlarged portion shown in FIG. 13, the body includes an outer circumferential surface 146 with a nub 144 projecting out therefrom. The pivoting body 114 has a finger 148 projecting outward toward the base 112 proximate its rear end 130.

As noted above, FIG. 10 depicts the intermediate rest position of the hinge assembly 100. Like the earlier embodiment of FIGS. 1-9, in the rest position, the rearward force on the plate 136 from the bias members 142 maintains the friction reducing members 138 against the front surface 116. In this embodiment, like the previous embodiment, the front surface 116 includes an inclined lower portion 118 that transitions forward from the apex 122 downward, which indirectly biases the pivoting body away from the activation position. The depicted lower portion 118 is substantially flat, however other embodiments include alternative configurations, such as, for example a concave surface similar to the lower portion 18 of the embodiment of FIG. 1.

Similar to the earlier embodiment, the hinge assembly 100 is movable to the lowered activated position shown in FIG. 11 via application of a force F downward on the top surface 124 of the pivoting body 118. The force F on the top surface 124 causes the pivoting body 118 to pivot about the axis A' with the friction reducing members 138 rolling downward along the ramp defined by the lower portion 118 of the front surface 116. Due to the inclination of the lower portion 118, the plate 136 slides forward relative to the pivoting body 114 against the bias member 142 as the pivoting body 114 is moved to the activation position shown in FIG. 11. The pedal may activate the device via any known activation mechanism, for example, mechanical, magnetic or another activation mechanism, as noted above with respect to the earlier embodiment of the assembly 10. Once the downward force F on the pivoting body 118 is released, the pivoting body 118 returns to the intermediate rest position with the friction reducing members 138 at the apex 122 via indirect forces from the bias member 142 against the plate 136, which cause the bearings 138 to roll against the lower portion 118 (upward in the Figures) until they abut the upper shoulder 120 at the apex 122.

In this embodiment of the hinge assembly 100, the pivoting body 114 can also be moved to the raised position shown in FIG. 12. Initially a user can disengage the bearings 138 from the apex 122 by applying a force $F_2$ against the shoulder (clockwise in the Figures), causing the plate 136 to slide forward against the bias member 142 as the friction reducing members travel against the shoulder 120. The pivoting body 114 is then movable to the raised position shown in FIG. 12 via further rotation. With reference to the enlarged portion shown in FIG. 13, the base 112 includes a partial circumferential surface 146 circumscribing the axis of rotation of the pivoting body (axis also defined by a lateral pin 117). A nub 144 projects from the circumferential surface 146 to form a locking member. Near the rear end 130 of the pivoting body 114, a finger 148 extends toward the circumferential wall in an operative position to slide over and then engage the nub 144. Engagement of the finger 148 by the nub 144, as shown in FIG. 12, "locks" the pivoting body 118 in the raised position shown in FIG. 12. Similar to the embodiment of the hinge assembly 10, the assembly 100 includes a space 126 rear of the partial circumferential surface 146 to accommodate the rear end 130 of the pivoting body 114 in the raised position. The pivoting body 114 can be returned to the intermediate position shown in FIG. 10 by forcing the finger 148 past the nub 144 and then forcing the friction reducing members 138 to the apex 122, causing the plate 136 to slide forward against the rear bias from the bias member 142 as the friction reducing members 138 travel past the shoulder 120.

FIGS. 1-3 and show approximate preferred angular dimensions of key components in the hinge assembly 10. These dimensions are exemplary of approximate angles at the rest position, activated position and raised position that have been shown to be particularly advantageous in the disclosed assembly 10, but are non-limiting to the inventive embodiments disclosed herein. Additionally, a preferred embodiment of the hinge assembly 10 or 100 used within the context of a foot pedal includes a base (12, 112) made from a rigid and durable material, such as a molded plastic, with a pedal and inner components made of a strong metal, such as steel. Other metals and/or polymers may be used for either the pivoting body or base, and particular preferred materials are of course non-limiting.

The embodiments of the rolling hinge assembly (10 and 100) disclosed herein provide a wealth of advantages over known hinge assemblies. First, the range of pivoting motion afforded by the rolling hinge assembly allows access to the underside of the pivoting body and otherwise concealed areas of the base for cleaning and other device maintenance. The direction of the bias force being substantially perpendicular or oblique to the movement path of the pivoting body (i.e., indirect biasing forces) provides significantly less mechanical stress and strain on the elements and the system as a whole, as compared to a substantially parallel to the path of movement like with a compression spring underneath the pivoting body (i.e., direct biasing forces). Furthermore, the path of travel of the pivoting body in the rolling hinge assembly is significantly smoother than in known systems, thereby improving the user comfort and experience. Again, although these preferred embodiments are generally described with reference to incorporation of the hinge assembly into a foot activation pedal, the hinge assembly itself is not limited as such and carries significant utility in settings outside of a pedal.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A hinge assembly, comprising:

a base member with a front surface;

a pivoting body with a front end and a rear end, the pivoting body being attached to and pivotable relative to the base member about an axis that is rear of the base front surface, the pivoting body including a friction reducing member biased against the base front surface, and the friction reducing member being retractable relative to the pivoting body in a rear-to-forward direction, wherein the friction reducing member is maintained by a plate that is maintained in a slidable relationship within a track in the pivoting body, and the front surface has a first inclined portion and the pivoting body is maintained in a rest position with the friction reducing member abutting an apex in the front surface, the pivoting body is pivotable in a first direction which causes the friction reducing member to move along the first inclined portion while retracting forward relative to the pivoting body.

2. The hinge assembly of claim 1, wherein the friction reducing member is biased from the pivoting body in a direction toward the base front surface.

3. The hinge assembly of claim 1, wherein the friction reducing member is rotatably attached to the plate.

4. The hinge assembly of claim 1, wherein the friction reducing member is a bearing that rolls along the first inclined portion while the pivoting body is pivoted in the first direction.

5. The hinge assembly of claim 1, wherein the front surface has a second inclined portion having a different angle of inclination from the first inclined portion, wherein the first inclined portion and second inclined portion meet at the apex.

6. The hinge assembly of claim 5, wherein the second inclined portion is positioned rear of the first inclined portion.

7. The hinge assembly of claim 6, wherein the pivoting body is pivotable from the rest position in a second direction to a raised position which causes the friction reducing member to move along the second inclined portion while retracting relative to the pivoting body.

8. The hinge assembly of claim 7, wherein the body includes a surface detent that engages the friction reducing member when the pivoting body is in the raised position.

9. The hinge assembly of claim 1, wherein the first inclined portion includes a portion that is concave in the forward direction.

10. The hinge assembly of claim 1, wherein the front surface includes an upper outwardly extending shoulder and the apex is defined between the shoulder and the first inclined portion.

11. The hinge assembly of claim 10, wherein the pivoting body is pivotable from the apex in a second direction opposite the first direction, thereby disengaging the friction reducing member from contact with the base member.

12. The hinge assembly of claim 1, wherein the base member includes a partial circumferential surface partially circumscribing the axis.

13. The hinge assembly of claim 12, wherein the pivoting body is pivotable from the rest position in a second direction opposite the first direction, thereby disengaging the friction reducing member from contact with the base member, to a raised position, comprising a nub projecting from the partial circumferential surface that engages a finger extending from the pivoting body to maintain the pivoting body in the raised position.

14. The hinge assembly of claim 1, wherein the base member includes a partial circumferential surface partially circumscribing the axis, the partial circumferential surface forming part of the second inclined portion and meeting the first inclined portion at the apex.

15. The hinge assembly of claim 14, wherein the pivoting body is pivotable in a second direction opposite from the first direction to a raised position with the friction reducing member traveling along the partial circumferential surface.

16. The hinge assembly of claim 1, wherein the friction reducing member is an end surface integrated within the plate maintained in a slidable relationship within a track in the pivoting body.

17. A hinge assembly, comprising:

a base member;

a pivoting body with a front end and a rear end, and attached to the base member with a friction reducing member attached to the pivoting body in abutment with a surface on the base member, the pivoting body being rotatable relative to the base member, wherein the friction reducing member is maintained by a plate that is maintained in a slidable relationship within a track in the pivoting body, and the pivoting body is pivotable from a rest position with the friction reducing member in a first position against the base member surface to an activation position with the friction reducing member in a second position against the base member surface, and wherein the friction reducing member moves against the base member from the first position to the second position while retracting relative to the pivoting body when the pivoting body is pivoted from the rest position to the activation position.

18. The hinge assembly of claim 17, comprising a bias member for biasing the friction reducing member from the pivoting body against the surface of the base member.

19. The hinge assembly of claim 18, wherein the surface of the base member includes an inclined portion between the first position and the second position, and the friction reducing member is forced inward relative to the pivoting body by pressure from the surface as the friction reducing member moves along the inclined portion.

20. A hinge assembly, comprising:

a base member defining a rolling surface with a lower ramp portion and an upper ramp portion that meet at an apex;

a pivoting body extending from a front end to a rear end and being attached to the base member via rotatable engagement, the pivoting body being rotatable relative to the base member about an axis positioned rear of the rolling surface;

a friction reducing member comprising a bearing maintained by a plate that is maintained in a slidable relationship within a track in the pivoting body, the plate and friction reducing member being reciprocable relative to the pivoting body in a rear-to-forward direction and biased relative to the pivoting body toward the rear direction, wherein the friction reducing member is maintained against the rolling surface in an intermediate position at the apex by the rearward bias, the pivoting body is pivotable about the axis in a first direction from the intermediate position to a lowered position with the bearing rolling along the lower ramp, and the pivoting body is pivotable about the axis in a second direction opposite from the first direction from the intermediate position to a raised position by disengaging the bearings from the apex.

21. The hinge assembly of claim 20, wherein the lower ramp portion has a concavity that is opposite from a concavity of the upper ramp portion.

22. The hinge assembly of claim 17, wherein the friction reducing member is selected from a rotatable member attached to the plate and an end surface integrated within the plate.

23. The hinge assembly of claim 17, wherein the friction reducing member is a bearing attached at a rear end of the plate.

24. The hinge assembly of claim 17, wherein the friction reducing member is an end surface integrated within the plate.

* * * * *